US008895907B2

(12) United States Patent
Lee

(10) Patent No.: US 8,895,907 B2
(45) Date of Patent: Nov. 25, 2014

(54) COOKING APPARATUS USING MICROWAVES

(75) Inventor: Won Hui Lee, Kyunggi-do (KR)

(73) Assignee: LG Electronics Inc., Seoul (KR)

( * ) Notice: Subject to any disclaimer, the term of this patent is extended or adjusted under 35 U.S.C. 154(b) by 1654 days.

(21) Appl. No.: 11/939,844

(22) Filed: Nov. 14, 2007

(65) Prior Publication Data

US 2008/0121635 A1 May 29, 2008

(30) Foreign Application Priority Data

Nov. 17, 2006 (KR) ..... 10-2006-0113825

(51) Int. Cl.
*H05B 6/64* (2006.01)
*H05B 6/74* (2006.01)
*F24C 15/32* (2006.01)

(52) U.S. Cl.
CPC ..... *H05B 6/6473* (2013.01)
USPC ..... 219/681; 219/749; 126/21 A

(58) Field of Classification Search
CPC ..... H05B 6/6473
USPC ..... 219/681, 749, 400, 401, 725, 679, 398, 219/399; 126/21 A, 21 R, 273 R, 4, 39 C, 20, 126/19 R; 428/422, 447; 99/476, 398; 426/523
See application file for complete search history.

(56) References Cited

U.S. PATENT DOCUMENTS

| | | | | |
|---|---|---|---|---|
| 4,327,266 | A * | 4/1982 | Austin et al. | 219/749 |
| 4,476,362 | A * | 10/1984 | Kusunoki et al. | 219/748 |
| 6,611,104 | B1 * | 8/2003 | Kim et al. | 315/39 |
| 2005/0087528 | A1 * | 4/2005 | Kanzaki et al. | 219/682 |
| 2006/0049183 | A1 * | 3/2006 | Eke et al. | 219/681 |
| 2007/0158328 | A1 | 7/2007 | Kim et al. | |
| 2007/0246453 | A1 | 10/2007 | Nam et al. | |
| 2007/0251936 | A1 | 11/2007 | Nam et al. | |
| 2007/0257020 | A1 | 11/2007 | Nam et al. | |

FOREIGN PATENT DOCUMENTS

| | | |
|---|---|---|
| JP | 2002-151248 | 5/2002 |
| KR | 10-2001-0004084 | 1/2001 |

OTHER PUBLICATIONS

English language Abstract of KR 10-2001-0004084.
English language Abstract of JP 2002-151248.
U.S. Appl. No. 11/979,003 to Lee et al., filed Oct. 30, 2007.

* cited by examiner

*Primary Examiner* — Quang Van
(74) *Attorney, Agent, or Firm* — Birch, Stewart, Kolasch & Birch, LLP

(57) ABSTRACT

A cooking apparatus which uses microwaves is provided such that the inside of the cooking apparatus may be formed more compactly than a conventional cooking apparatus. That is, the number of parts and the assembling process may be reduced by providing a convector (e.g., provided at a side of the cooking chamber) which circulates the inner air of the cooking chamber, and a microwave supplier provided at the convector to supply the microwaves into the cooking chamber through the convector.

6 Claims, 6 Drawing Sheets

COOKING APPARATUS USING MICROWAVES

This application claims the benefit of the Korean Patent Application No. 2006-0113825, filed on Nov. 17, 2006, which is hereby incorporated by reference in its entirety.

BACKGROUND OF THE INVENTION

1. Field of the Invention

The present invention relates to a cooking apparatus which uses microwaves. More particularly, the present invention relates to an inner part of the cooking apparatus which may be provided compactly thereby reducing the number of components, the assembling processes and the manufacturing costs of the cooking apparatus.

2. Description of the Conventional Art

In general, a cooking apparatus which utilizes microwaves is capable of evenly cooking the contents provided therein in a short period of time. In this regard, the contents (or object to be cooked) are subjected to molecule vibrations as microwaves are irradiate to a non-conducting substance such as foods (i.e., the contents of the oven).

The cooking apparatus which utilizes microwaves includes a microwave oven (MWO) to cook the contents provided in the cooking chamber by irradiating microwaves, an over the range (OTR) having a hood function which exhausts smoke and smell (i.e., odor), and is arranged on the upper side of another cooking apparatus, and an electric oven having a heater and a microwave cooking function.

A microwave supply unit which supplies microwaves into the cooking chamber is arranged at a side of the cooking chamber in the cooking apparatus. Further, in a recent cooking apparatus, a convection unit which forcibly circulates the inner air of the cooking chamber is arranged at another side of the cooking chamber.

However, the recent cooking apparatus which utilizes microwaves according to the conventional art has at least one disadvantage in that the inner organization is very complex, as each of the microwave supply unit and convection unit is arranged at one side and the other side (i.e., an opposite side) of the cooking chamber, respectively. Therefore, the cooking apparatus is limited because it does not effectively reduce the installation space of the microwave supply unit and the convection unit, the number of parts provided in the cooking chamber, the number of assembling processes and manufacturing costs.

SUMMARY OF THE INVENTION

An object of the present invention is to provide a cooking apparatus which is organized to be simple and compact by reducing the number of parts (i.e., components), the assembling process and manufacturing costs.

To achieve the above-mentioned object, the present invention provides a cooking apparatus (which utilizes microwaves) including a convector which circulates inner air of the cooking chamber and is provided at a side of the cooking chamber. Additionally, the cooking apparatus may be provided with a microwave supplier which supplies microwaves into the cooking chamber via (or through) the convection unit.

The convector may include a convection chamber having an air intake and an air outlet provided between the cooking chamber and the microwave supplier, which may provided inside of the convector. Additionally, a convection fan may be provided inside of the convection chamber. Additionally, the convector may further include a convection heater which heats the air blown toward the air outlet by the convection fan.

Further, on the convection chamber, a microwave guide which guides microwaves radiated from the microwave supplier into the convection chamber may be provided. The microwave supplier may include a magnetron provided at (or proximate) the microwave guide.

The convection fan may include a blower (e.g., a blowing fan) rotatably provided in the convection chamber and a fan driver which is configured to rotated the blower, which may be provided proximate the convection chamber. Further, the blowing fan may include a conductor, and the convection fan may be provided between the cooking chamber and the microwave supplier in a front-to-rear direction of the cooking apparatus.

According to another aspect of the present invention, a cooking apparatus which utilizes microwave may include a convector which circulates the inner air of the cooking chamber, a microwave supplier provided at (or proximate) the convector to supply microwaves into the cooking chamber via (or through) the convector, and a microwave radiator provided in the convector to reradiate the microwaves supplied to the microwave supplier.

The microwave radiator may include a conductor having a slot to reradiate the microwaves. The width of the slot may be not less than approximately one fourth (¼) of the wavelength of the microwave. The slot may be provided having either one of a polygonal shape or a round shape. The slot may be provided (or formed) at the microwave radiator as a plurality of slots having at least either one of the polygonal or round shapes. Additionally, the slot(s) may be provided having various patterns.

The convector may include a convection chamber provided in the cooking chamber and having an air intake and an air outlet connected to the cooking chamber. Additionally, a convection fan may be provided in the convection chamber.

At the convection chamber, a microwave guide which guides the microwaves radiated from the microwave supplier into the convection chamber may be formed. The microwave supplier may include a magnetron provided at (or proximate) the microwave guide. The microwave radiator may be provided at the junction (or joint portion) of the convection chamber and the microwave guide.

The convection fan may include a bower (or blowing fan) rotatably provided in the convection chamber and a fan driver configured to rotate the blower. Further, the blower may include a conductor. Additionally, the convection fan may be provided between the cooking chamber and the microwave supplier. Further, the microwave radiator may be provided between the cooking chamber and the convection fan in a front-to-rear direction of the cooking chamber.

BRIEF DESCRIPTION OF THE DRAWING

The present invention is further described in the detail description which follows, in reference to the noted plurality of drawings, by way of non-limiting examples of preferred embodiments of the present invention, in which like characters represent like elements throughout the several views of the drawings, and wherein.

DETAILED DESCRIPTION OF THE PREFERRED EMBODIMENT

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Reference will now be made in detail hereinafter as for the preferred embodiment of the cooking apparatus using microwave according to the present invention with reference to the accompanying drawings.

Figure 1:
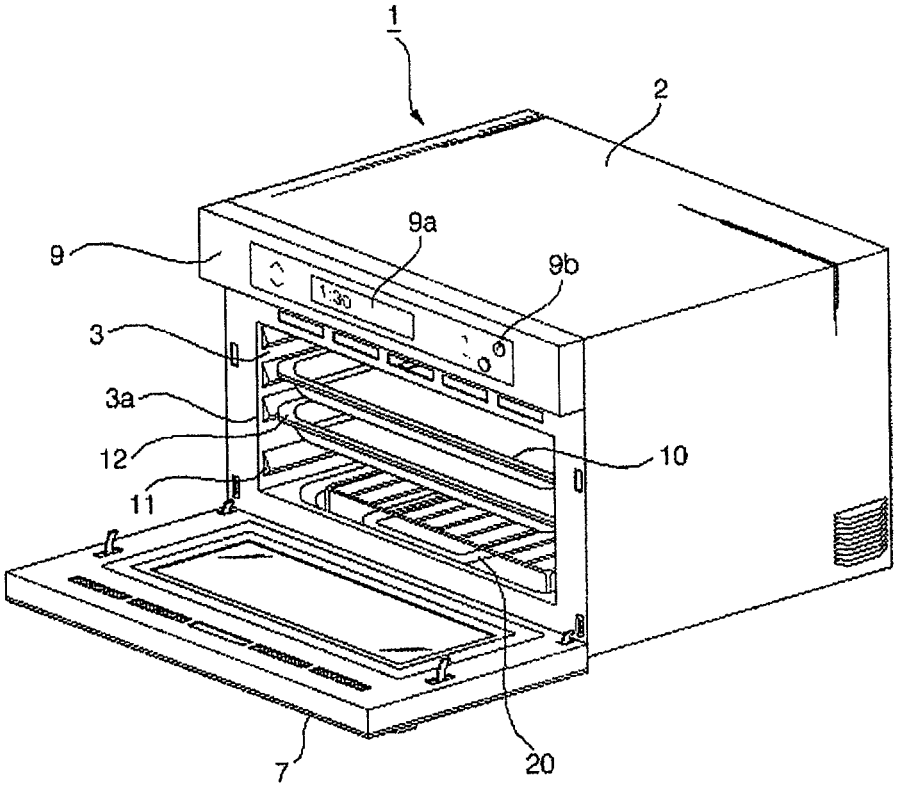
FIG. 1 is a perspective view illustrating the electronic oven (which uses microwaves) according to a preferred embodiment of the present invention.
Figure 2:
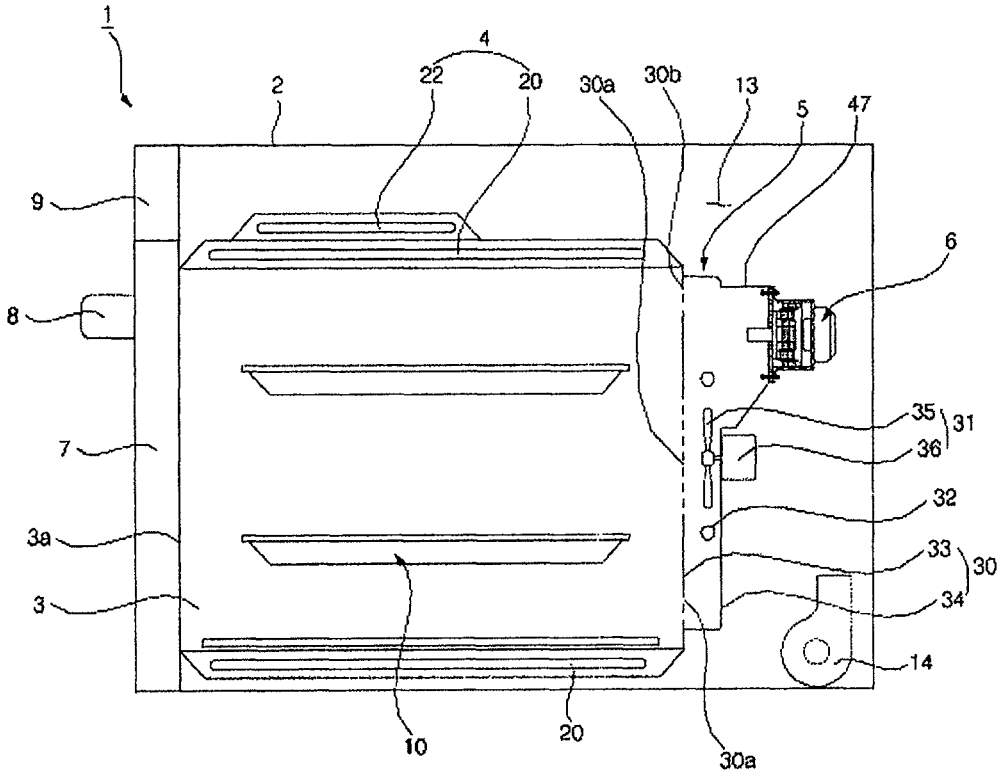
FIG. 2 is a schematic diagram broadly illustrating a convector of the electronic oven illustrated in FIG. 1.

Referring to FIGS. 1 and 2, the electronic oven 1 includes a casing 2 having a door 7 which is configured to be opened and closed. Further, a cooking chamber 3 is provided inside of the casing 2 and includes an opening (or entrance 3*a*) provided at the front of the casing (i.e., for introducing and removing contents). Additionally, the cooking apparatus may be provided with a heater 4 (located in the cooking chamber) to heat the inner part of the cooking chamber 3, a convector 5 which circulates the inner air of the cooking chamber 3 (provided proximate the rear surface of the cooking chamber 3), and a microwave supplier 6, which supplies microwaves into the cooking chamber 3 via (through) the convection unit 5, provided at (or proximate) the convector 5.

The casing 2 may be formed having a generally box-shape the front of which may be configured to open and close, and having components such as the cooking chamber 3, the microwave supplier 6, etc. provided therein. The door 7, which may be configured to open and close the entrance 3*a*, may be provided on the front surface of the casing 2 to be rotated so at to open and close the entrance 3*a*. The door may be opened and shut by utilizing a drop down method (i.e., the door may be rotated about its bottom edge), and may have a knob 8 provided on the front surface thereof. Further, a control panel 9 may be provided at a part (or on a portion) of the front surface of the casing 2 at an area where the door 7 is not provided. The control panel 9 may include a display 9*a* which displays the operation condition of the electronic oven 1, and an operator 9*b* which may be configured to select the cooking mode or control the operation of the electronic oven 1.

The cooking chamber 3 may be a generally box-shaped member made of a conductive material which forms a cavity for receiving contents (e.g., an object to be cooked). A tray 10, on which contents may be placed and cooked, may be removably provided inside of the cooking chamber 3. A slide supporter 11, which supports the removable tray 10, may be configured to slide back and forth, and may be provided on the side parts (or surfaces) of the cooking chamber 3. Additionally, a flange portion 12 may be slidably laid over the slide supporter 11, and may be formed at the end parts of the tray 10. The slide supporter 11 may be provided as a plurality of oppositely facing slide supporters 11, in the up and down direction at the inner side parts of the cooking chamber 3. Likewise, the tray 10 may be provided as a plurality of multi-staged trays 10 which extend up and downward directions inside of the cooking chamber 3.

Further, an electric component chamber 13 may be provided between the cooking chamber 3 and the casing 2. Additionally, a cooling fan 14 may be provided in the electric component chamber to cool the control panel 9, door 7, magnetron 6 and etc.

The heater 4 may include a first heater 20 provided proximate upper and lower sides of the cooking chamber to heat the inside of the cooking chamber 3, and a second heater 22 provided proximate an upper side of the chamber 3, which supplies radiant heat into the cooking chamber 3 (e.g., in the form of ray(s) of light). In this regard, a sheath heater having a hot wire in the inside of the metallic protection pipe may be used for the first heater 20. Further, a halogen heater having hot wire in the inside of the quartz pipe having halogen elements may be used for the second heater 22. However, it is appreciated by one of ordinary skill in the art the any suitable heater may be employed and provided at any suitable location within the cooking chamber 3.

Figure 3:
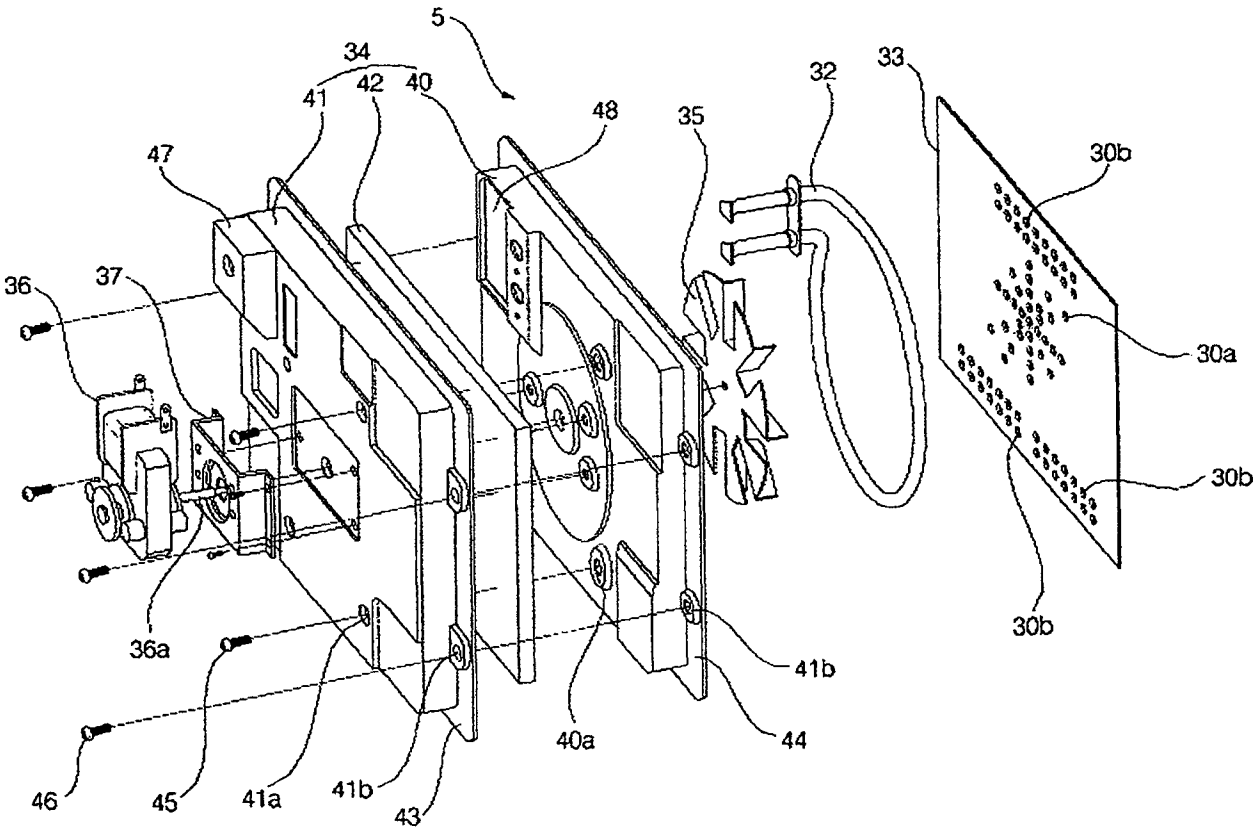
FIG. 3 is a disassembled perspective view illustrating a convector of the electronic oven illustrated in FIG. 2.

Referring to FIGS. 2 and 3, the convector 5 may be an apparatus supplying the heated air inside of the cooking chamber 3 thereby cooking the contents provided therein (e.g., on the tray 10) by circulating hot air. That is, the convector 5 improves the uniform heating performance of the contents by forcibly circulating the inner air of the cooking chamber 3 which has been heated by the heating unit 4 or the microwave supplier 6.

The convector 5 may include a convection chamber 30 provided proximate the rear surface of the cooking chamber 3, the convection chamber 30 being provided with a microwave supplier 6, and having an air intake 30*a* and an air outlet 30*b* provided between the cooking chamber 3 and the convection chamber in a front-to-rear direction of the cooking apparatus, a convection fan 31 provided in the convection chamber 30, and a convection heater 32 which heats the air exhausted through the air outlet 30*b*, the convection heater 32 being provided between the convection fan 31 and the air outlet 30*b*.

The convection chamber 30 may include a convection panel 33 configured to open and shut a hole (or opening) formed at the rear surface of the cooking chamber 3. Further, the convection chamber may include the air intake 30*a* and the air outlet 30*b*, and a convection cover 34 provided rearward of the convection panel 33 such that a predetermined space formed between the convection panel 33 and the convection cover. Additionally, the microwave supplier 6 may be provided in the convection chamber 30.

The convection panel 33 may formed of a non-conductive material which is permeable to microwaves (e.g., a mica sheet). Therefore, the microwaves generated by the microwave supplier 6 may be transmitted into the cooking chamber 3 from the convection chamber 30 via (or through) the convection panel 33. Additionally, the convection panel 33 may have a plurality of air intakes 30*a* at the front of the convection fan 31, as well as a plurality of air outlets provided at the other parts of the convection fan 31. That is, the air outlets 30*b* may be formed at a part (or location) adjacent to the air intakes 30*a* and extend for a predetermined distance. However, it is appreciated by one of ordinary skill in the art that convection panel 33 may be employed having any suitable structure and utilizing any suitable material.

The convection cover 34 may include a front cover 40 provided at the rear surface of the convention fan 31 and providing a predetermined space between the convection panel 33 and a rear of the convection cover, a rear cover 41 provided at the rear surface of the front cover 40, and an insulator 42 provided between the rear cover 41 and the front cover 40. Additionally, a plurality of first coupling holes 40*a* and 41*a* may be formed at the front cover 40 and the rear cover 41 to correspond to each of the front cover 40 and the rear cover 41, and the front cover 40 and the rear cover 41 may be fixed, e.g., via the plurality of first couplers 45 (e.g., any suitable fasteners) and providing the insulator 42 in between. The flange portions 43 and 44 may be formed along the circumference at the sides of the front cover 40 and the rear cover 41, and a plurality of second coupling holes 40*b* and 41*b* may be correspondingly formed on the flange portions 43 and 44, respectively. The flange portions 43 and 44 may be fixed (e.g., coupled at the rear surface of the cooking chamber 3) to one another via the second coupler 46 (e.g., any suitable fastener). The insulator 42 may be provided with a material having excellent thermal resistance and heat insulation quality, e.g., glass wool or mineral wool. However, it is appreciated by one of ordinary skill in the art that any suitable material may be employed.

At the rear cover 41, a microwave supplier 6 may be provided, and a microwave guide 47 which guides the microwave generated by the microwave supplier 6 into the convection chamber may be provided. The microwave guide 47 may be provided at the rear surface of the microwave supplier 6, and projecting outwardly from the rear cover. A penetration hole 48, through which the microwaves penetrate, may be provided at the part (or location) which corresponds to the microwave guide 47, and may be provided on the front cover 40.

The convection fan 31 may include a blower (or centrifugal blowing fan) 35 provided in the convection chamber 30 oppositely facing the air intake 30*a*, and a fan driver 36 provided at the convection chamber 30. Additionally, the fan driver 36 may include a rotation shaft 36*a* connected to the centrifugal blowing fan 35.

The centrifugal blowing fan 35 may include a conductor and is positioned about halfway (i.e., one half the distance) between the microwave guide 47 and the convection panel 33. Therefore, the centrifugal blowing fan 35 improves the uniformity of the microwave field formed in the cooking chamber 3 by stirring the microwaves transmitted through the convection panel 33 from the microwave guide 47. In other words, the centrifugal blowing fan 35 provides a function similar to the stirrer of a conventional microwave oven.

The fan driver 36 may include an electric motor. The fan driver 36 may be mounted at the rear surface of the convection cover 34 by a mounting bracket 37, and may be coupled to the centrifugal blowing fan 35 via the rotation shaft 36*a*. Additionally, the rotation shaft 36*a* may penetrate generally a center of the convection cover 34.

The convection heater 32 may include a generally ring-shaped sheath heater provided at the outer circumference of the centrifugal blowing fan 35. The convection heater 32 heats the air blown by the centrifugal blowing fan 35 to the air outlet 30*b*.

The microwave supplier 6 may include a magnetron 6 provided on the microwave guide 47 and generating microwaves transmitted into the microwave guide 47.

Reference will now be made in detail as to the operation and operation effects of the electronic oven 1.

Firstly, contents (i.e., objects to be cooked) may be placed on each of the plurality of trays 10. In this regard, the door of the electronic oven 1 may be opened and the trays 10 may be provided on the sliding support unit 11 of the cooking chamber 3 to be multi-staged. Further, the cooking chamber 3 may be shut by closing the door, and the electronic oven 1 may be operated after setting a cooking mode to cook the contents. In this regard, the cooking mode may be set via the operator 9*b* provided on the control panel 9.

Subsequently, the inside of the cooking chamber 3 may be heated by the heater 4, microwaves may be introduced from the microwave supplier 6, and an air flowing condition may be generated by the convector 5 which may be provided in the inside of the cooking chamber 3.

Further describing the operation of the heater 4 in detail, the inside of the cooking chamber 3 may be heated by radiant heat as the first heater 20, which may be provided at the upper side and the lower side of the cooking chamber, is operated, and the radiant heat may be transmitted into the cooking chamber 3 (e.g., in a form of a light wave(s) as the second heater 22 which is provided at the upper side of the cooking chamber 3 is operated. Additionally, the second heater 22 may have some advantages over the first heater 20 in that the heat loss of the second heater 22 may be less and the second heater may be rapidly heated in comparison to the first heater 20 (e.g., as the heat of the second heater 22 is transmitted in the form of a light wave(s)). As described above, the contents of the cooking apparatus, which may be placed on the trays 10, may be heated with the radiant heat from the first heater 20 and the second heater 22.

Further describing the operation of the convector 5 in detail, the air between the cooking chamber 3 and the convection chamber 30 may be forcibly circulated with the convection fan 31, and the air circulated with the convection fan 31 may be reheated with the convection heater 32. That is, the air in the cooking chamber 3 may be inhaled into the convection chamber 30 through the air intake 30*a* by the convection fan 31, and the inner air of the convection chamber 30 heated by the convection heater 32 may be exhausted into the cooking chamber 3 via (or through) the air outlet 30*b* by the convection fan 31. Furthermore, the exhausted air may be re-inhaled into the convection chamber 30 through the air intake 30*a* after passing the trays 10 arranged in the cooking chamber 3.

As the inner air of the cooking chamber 3 is circulated forcibly by the convector 5, the heat of the heater 4 or of the convection heater 32 may be equally transmitted to each of the trays 10, which may be provided as a plurality of multi-staged trays, by the convective condition of the air. Therefore, the uniform heating performance of the electric oven 1 may be improved through the convector 5, and the cooking time may be shortened due to the increase in the amount of heat transmitted to the contents.

Further describing the operation of the microwave supplier 6 in detail, microwaves generated by the magnetron 6, may be transmitted into the convection chamber 3 through the microwave guide 47, and may be radiated into the cooking chamber via (or through) the convection chamber 30. The microwaves radiated into the cooking chamber 3 evenly heat the inside of the contents as rays are transmitted to the contents which may be placed on the trays 10. Therefore, the convection chamber 30 not only leads (or guides) the microwave of the microwave supplier 6 to the cooking chamber 3, but also provided a path through which the air in the cooking chamber 3 may be circulated.

When both of the microwave supplier 6 and the convection fan 31 are operated at the same time, the microwaves of the microwave supplier 6 may be equally radiated into the cooking chamber 3 (i.e., as the microwaves are stirred by the centrifugal blowing fan 35 of the convection fan 31). Therefore, the uniform heating performance of the contents may be improved as the uniformity of the microwave field of the electric oven 1 is improved.

Figure 4:
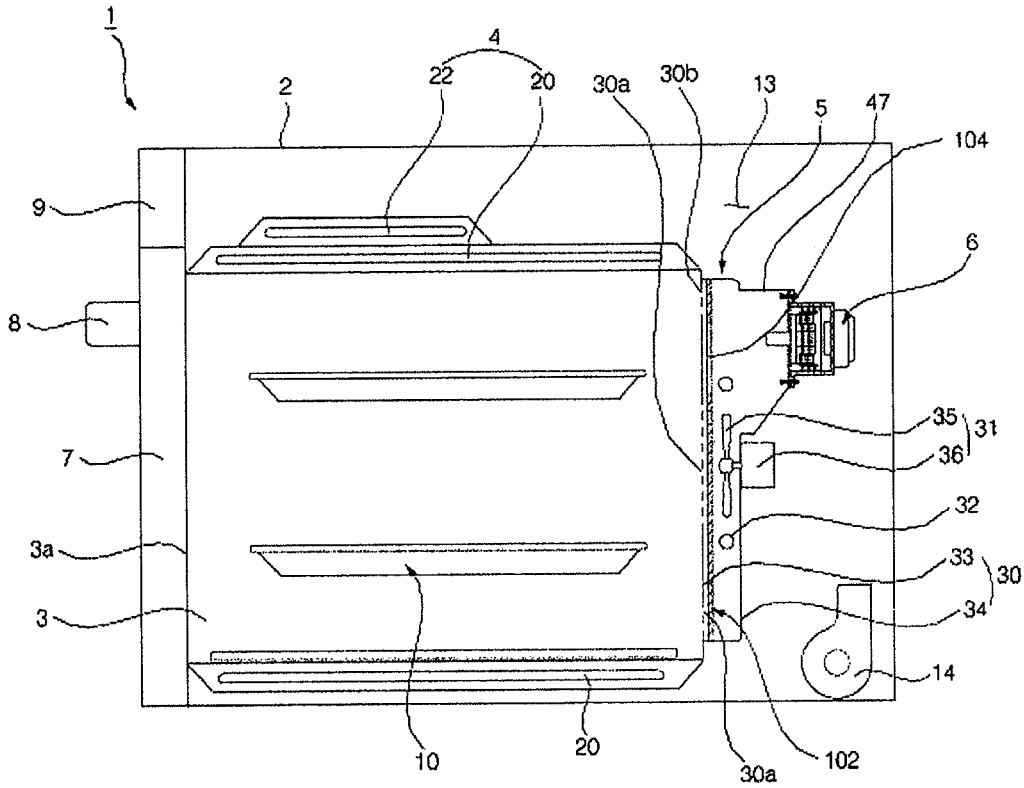
FIG. 4 is a cross-sectional view illustrating the electronic oven (which uses microwaves) according to another preferred embodiment of the present invention.
Figure 5:
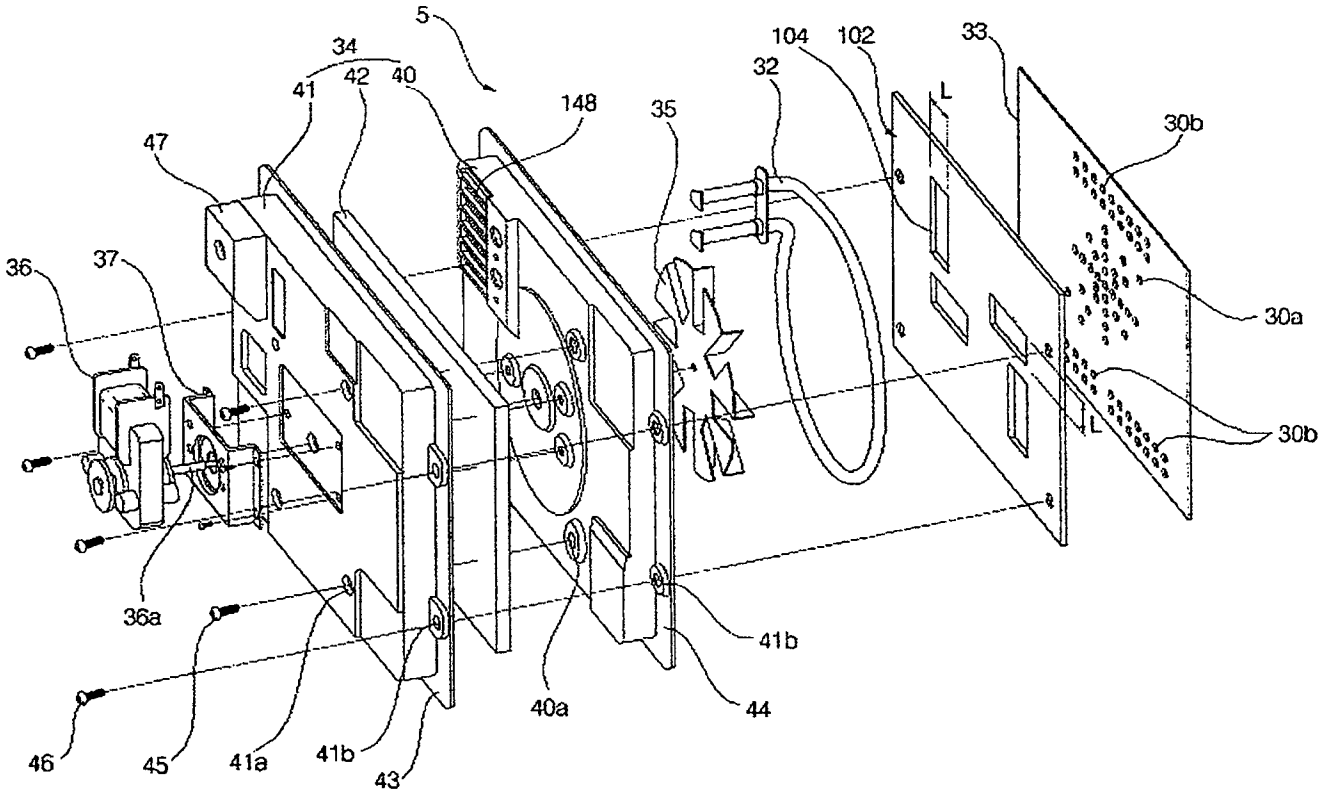
FIG. 5 is a disassembled perspective view illustrating a convector of the electronic oven illustrated in FIG. 4, FIGS. 6 A-F are front views illustrating other examples of the microwave radiator illustrated in FIG. 5.
Figure 6:
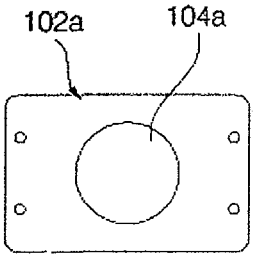
Figure 6:
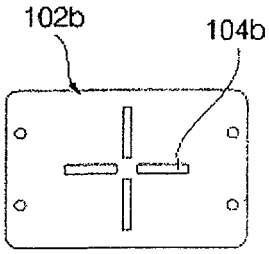
Figure 6:
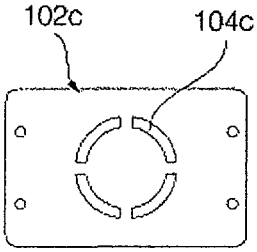
Figure 6:
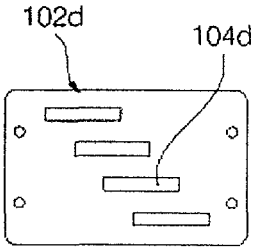
Figure 6:
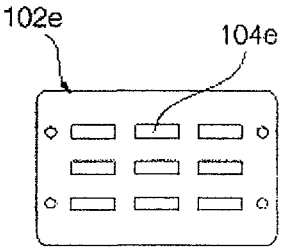
Figure 6:
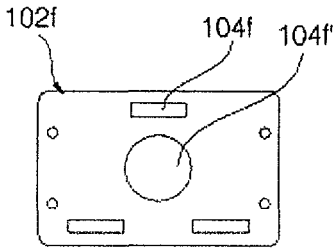

Further, when the cooking of the contents is completed via (or through) the heater 4, convector 5 and microwave supplier 6, the signal representing the completion of cooking may be displayed through the display 9*a* of the control panel 9, and a user may remove the trays 10 one by one out of the cooking chamber 3 after opening the door 7. FIG. 4 is a cross-sectional view illustrating the electronic oven using microwaves according to another preferred embodiment of the present invention, FIG. 5 is a disassembled perspective view illustrating a convection unit of the electronic oven illustrated in FIG. 4, and FIG. 6 is a front view illustrating other examples of the microwave radiator illustrated in FIG. 5. The same reference numerals are given to the components the same or similar to a preferred embodiment of the present invention in FIGS. 4 to 6. It is described on the following that the points different with a preferred embodiment of the present invention as the central figures.

Referring to FIGS. 4 and 5, the difference between the electric oven 100 of the present embodiment and the electric oven 1 illustrated in FIGS. 2 and 3 is that the electric oven 100 of the further embodiment further includes a microwave radiator 102 which reradiates the microwave radiated from the microwave supplier 6.

The microwave radiator 102 may be provided in the convection chamber 30 and may have a generally board-shape (or flat-shape), and may be positioned between the convection fan 31 and the convection panel 33. The microwave radiator 102 may be fixed (or coupled) at the rear surface of the cooking chamber 3 by a second coupler (or fastener) 46 to the convection cover 34. Of course, one of ordinary skill in the art would appreciate that it is possible for the microwave radiator 102 to be provided at the convection cover 34 or cooking chamber 3 by utilizing any suitable coupler (or fastener).

The microwave radiator 102, as described above, may include a conductor. Additionally, a slot 104 may be formed on the microwave radiator 102 to re-radiate the microwave. A width L of the slot 104 may be not less than approximately one-fourth (¼) of the wavelength of the microwave(s) generated at the microwave supplier 6.

That is because it is virtually impossible for the microwave to pass through the slot 104, when the width L of the slot is smaller than ¼ of the wavelength of the microwave. The slot 104 may be formed at the microwave radiator 102 having a generally rectangular form (or shape) and a plurality of the radiant units may be provided adjacent to each other. Therefore, the uniform heating performance may be greatly improved, as the microwave field formed in the cooking chamber 3 improved as the microwave of the microwave supplier 6 is re-radiated into the cooking chamber uniformly as the microwaves pass through the slot 104 of the microwave radiator 102.

Further, the slot 104 is not limited to the present embodiment. In this regard, it is possible that a plurality of slots may be formed having either one of a generally polygonal or generally round shape. Further, t a plurality of slots of at least one shape between the polygon round shape are may be provided having various patterns at the microwave radiator 102. As illustrated in FIGS. 6 A-F, the microwave radiator may be provided with various kinds of slots. The microwave radiator 102*a* illustrated in FIG. 6A has one slot 104*a* of round shape, each of the microwave radiant units (i.e., a plurality of microwave radiators) 102*b*, 102*c*, 102*d* and 102*e* illustrated in FIGS. 6A, B, C and D and E has a plurality of slots 104*b*, 104*c*, 104*d* and 104*e* of rectangular form or arc form, and the microwave radiant unit 102*f* illustrated in FIG. 6F has both of the plurality of slots 104*f* of rectangular form and one slot 104*f'* of round shape.

The microwave field formed in the cooking chamber 3 may be changed in accordance with the shape and the arrangement pattern of the slot 104. Therefore, the performance of the cooking apparatus may be improved as the microwave radiator 102 is used as a tuning factor while providing the electric oven 1.

Further, at the front cover 40 of the convection cover 34, it is formed at the parts corresponds to the microwave guide 47 of the rear cover 41 that a plurality of penetration hole 148 through which microwave passes. The penetration holes 148 may be formed with the width longer than ¼ against the wavelength of the microwave to re-radiate the microwave as the slot 104. Further, the penetration holes 148 may be formed having various shapes and patterns. Therefore, the microwave of the microwave supplier 6 may be re-radiated by both the penetration hole 148 and slot 104.

The cooking apparatus which uses microwaves according to the present invention is described as above with reference to the accompanying drawings, however, the present invention isn't limited to the preferred embodiment and the drawings and is possible to be changed by the present manufacturer in various forms in the field of boundary of the technical idea of the present invention.

That is, the present invention is applicable to all cooking apparatus having a convector and microwave supplier. Further, it is possible to change the microwave radiator, if it is necessary, as the convection panel and microwave radiator in the convector of the present invention is composed to be assembled and removed in the cooking chamber. Furthermore, the microwave guide may not be formed at the convection chamber of the convector, and the magnetron may be provided directly at the convection chamber in the present invention.

As described above, the cooking apparatus which uses microwaves according to the present invention has at least on advantage in that the cooking apparatus may be constructed so as to be more compact and simple. In this regard, the microwave supplier may be provided at the convector.

Further, the cooking apparatus which uses microwaves according to the present invention has at least another advantage in that the numbers of components, the assembling processes, and the manufacturing costs may be reduced as compared to the case where the convector and microwave supplier are installed separately.

Further, the cooking apparatus which uses microwaves according to the present invention has at least another advantage in that the uniform heating performance due to the microwave may be improved, as the microwave radiated from the microwave supplier is re-radiated by the microwave radiator provided in the convector.

It is further noted that the foregoing examples have been provided merely for the purpose of explanation and are in no way to be construed as limiting of the present invention. While the present invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A cooking apparatus which utilizes microwaves, the cooking apparatus comprising:

a convector which circulates inner air of a cooking chamber, the convector comprising a convection chamber; and a microwave supplier which supplies microwaves into the cooking chamber through the convector, wherein the convection chamber comprises:

a convection panel formed at one side of the cooking chamber and provided with at least one of a plurality of air outlet holes and air inlet holes;

a convection cover spaced from the convection panel; and a convection blower provided between the convection panel and the convection cover, and wherein the convection cover comprises:

a first cover;

a second cover disposed opposite to the convection blower with respect to the first cover; and an insulator panel provided between the first cover and the second cover.

2. The cooking apparatus according to claim 1, wherein the convector further comprises a convection heater which heats the air introduced through the air intake.

3. The cooking apparatus according to claim 1, further comprising a microwave guide, which guides the microwaves radiated from the microwave supplier to the convection chamber, formed at the second cover, wherein the microwave supplier is mounted on the microwave guide.

4. The cooking apparatus according to claim 3, wherein the microwave supplier comprises a magnetron.

5. The cooking apparatus according to claim 1, wherein a fan driver for rotating the convection blower is mounted on the second cover.

6. The cooking apparatus according to claim 1, wherein a fan driver for rotating the convection blower is mounted on the second cover.

* * * * *